United States Patent [19]

Kamishima

[11] Patent Number: 4,866,228

[45] Date of Patent: Sep. 12, 1989

[54] KEY SWITCH WITH MULTIPLE CONTACT POINTS

[75] Inventor: Osamu Kamishima, Tokyo, Japan

[73] Assignee: SMK Co., Ltd., Tokyo, Japan

[21] Appl. No.: 123,554

[22] Filed: Nov. 20, 1987

[51] Int. Cl.[4] ..... H01H 13/52

[52] U.S. Cl. ..... 200/345; 200/533

[58] Field of Search ..... 200/340, 159 A, 153 LA, 200/275, 284, 288, 301, 573, 533, 345

[56] References Cited

U.S. PATENT DOCUMENTS

| | | | |
|---|---|---|---|
| 3,030,479 | 4/1962 | Ehrlich et al. | 200/284 |
| 3,626,131 | 12/1971 | Stow et al. | 200/153 LA |
| 4,154,997 | 5/1979 | Grebner et al. | 200/159 A |
| 4,342,892 | 8/1982 | Ayers | 200/159 A |
| 4,439,655 | 3/1984 | Borter | 200/340 |
| 4,673,778 | 6/1987 | Lewandowski et al. | 200/284 |

*Primary Examiner*—Renee S. Luebke

*Attorney, Agent, or Firm*—Lowe, Price, LeBlanc, Becker & Shur

[57] ABSTRACT

A key switch is disclosed wherein a key stem is slidably movable within a switch case. Upward movement of the key stem under spring bias causes electrical disconnection between a stationary contact and a movable leaf-spring terminal type contact both mounted within the switch case. The stationary contact is a wire engaging a sheet metal type leaf-spring terminal contact having notches to provide plural contact points therebetween.

16 Claims, 2 Drawing Sheets

KEY SWITCH WITH MULTIPLE CONTACT POINTS

BACKGROUND OF THE INVENTION

The present invention relates to a key switch wherein the slide of a key stem causes the leaf-spring terminal in the switch case to be depressed to make a contact of a leaf-spring terminal and a contact of a stationary terminal selectively engage with each other.

In the conventional key switch, it is common for the leaf-spring terminal in the switch case and the stationary terminal to be arranged as illustrated in FIG. 7. That is, in the leaf-spring terminal 1, contact 2, projecting part 3 and contact 4 are formed by bending a rectangular sheet, whereas the stationary terminal 5 is formed from a sheet punched into L-shape so that one side of which serves as the contact 6 and the other side as terminal 7. A key stem (not shown in the drawing) is made slidable both upward and downward so that the depressor of the key stem can either depress the projecting part 5 of the leaf-spring terminal 1 or release the projecting part from the depression in order to keep the contact 3 of the leaf-spring terminal 1 and the contact 6 of the stationary terminal 5 in contact with or separated from each other.

As discussed previously, however, in the conventional key switch, both the contact 2 of the leaf-spring terminal and the contact 6 of the stationary terminal 5 are formed from the flat sheet, so that they tend to contact only at a point when the surfaces of the contacts are not completely flat, thereby causing poor contact and low realiability of the contact.

Thus, an object of the present invention is to provide a key switch whereby a satisfactory and highly reliable contact can be obtained by shaping both the leaf-spring terminal and the stationary terminal into forms that enable them to contact at plural number of points for better contact and reliability.

According to the present invention, in order to realize said object, one or plural number of notches are provided in the contact of the leaf-spring terminal, and the stationary terminal is made from wire so that the contact between the contact of the leaf-spring terminal and the contact of the stationary terminal can be made at a least at plural number of points, which is one of the features of the present invention.

Thus, the key switch according to the present invention can provide better contact and reliability of contact than those of the conventional key switch.

Other objectives and features of the present invention will be clarified through the detailed explanation of the specification and the drawings.

DETAILED DESCRIPTION OF THE INVENTION

Figure 1:
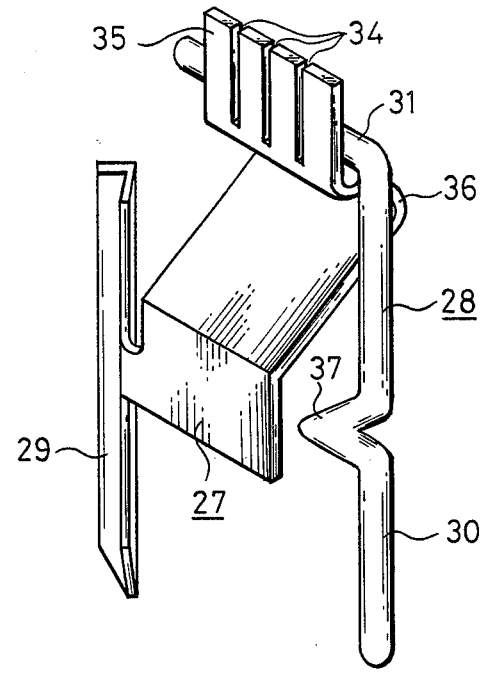
FIG. 1 is an oblique perspective drawing showing the main part of a key switch as an embodiment of the present invention.
Figure 2:
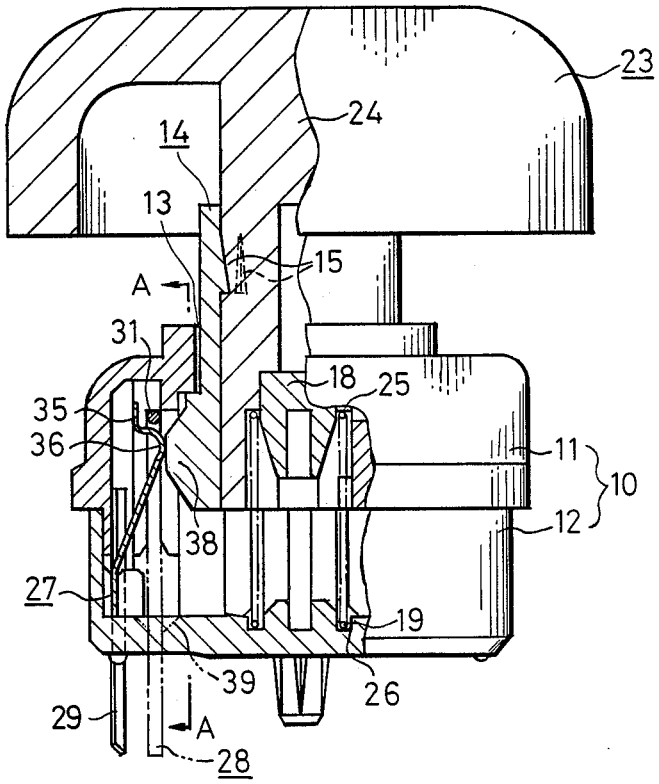
FIG. 2 is a partial cut-away view of the front of the key switch including the main part shown in FIG. 1.
Figure 4:
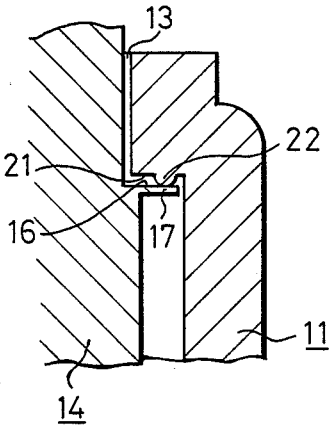
FIG. 4 is a cross-sectional drawing showing the cross section along A—A line of the key switch shown in FIG. 2.
Figure 5:
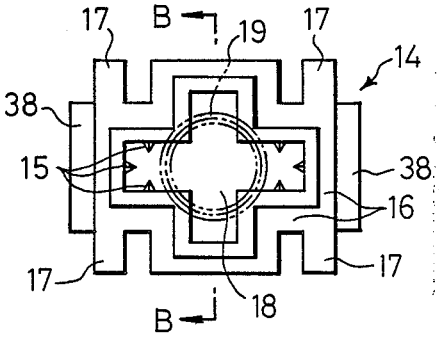
FIG. 5 is an enlarged drawing of the key stem shown in FIG. 2.
Figure 6:
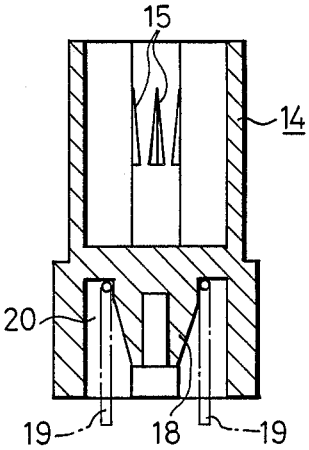
FIG. 6 is a cross-sectional drawing showing the cross section along B—B line shown in FIG. 5.
Figure 7:
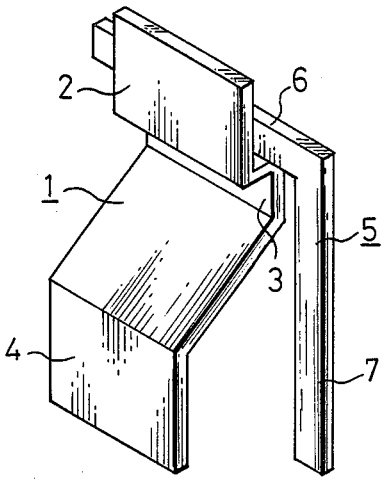
FIG. 7 PRIOR ART
FIG. 7 is an oblique perspective view of the main part of the conventional key switch.

In FIGS. 1 and 2 showing an embodiment of the present invention, switch case 10 comprises case cover 11 and case bottom cover 12 which are fitted and fixed to each other. The top plate of case cover 11 has an opening 13, is fitted to key stem 14 that can slide up and down. As shown in FIGS. 5 and 6, key stem 14 has an upper cylindrical section and a lower cross-shaped interior cross section, wherein stoppers 15—15 project from the upper inside wall of the cylinder. A step 16 serving as a stopper is formed on the outside wall at the middle of the cylinder; tongues 17—17 to serve as guides project from the four corners of said step 16; spring insertion hole 20 for receiving one end of a coil spring 19 is provided around central projection 18 on the lower inside wall of the cylinder; and a depressor 38 projects from the lower outside wall of the cylinder. As shown in FIG. 4, the tongues 17—17 of key stem 14 prevents stopper step 16 from directly contacting the stopper step 21 of case cover 11 to prevent contact noise by contacting the projection 22 in advance. An actuating part 24 of key top 23 is forced into and locked in key stem 14, and step 25 is formed at the bottom of part 24 so that the part of one end of said coil spring 19 can be fitted between the central projection 18 of key stem 14 and the actuating part. An insertion hole 26 is provided to the top of the bottom plate of said case bottom cover 12 so that the other end of coil spring 19 can be fitted, whereby the coil spring pushes up key stem 14 and the key top 23 integrally locked to said key stem 14. As shown in FIG. 1, case cover 11 is provided with leaf-spring terminal 27 and the stationary terminal 28, and the terminal members 29 and 30 of these terminals 27 and 28 are not only locked to case cover 11 but also pass through case bottom cover 12 to project outside when they are installed. The end 31 of the contact 30 of said stationary terminal is locked in said case cover 11. The bottom plate of said case bottom cover 12 is provided with terminal insertion hole 39 for inserting the terminal member 30 of stationary terminal 28, and terminal insertion hole 39 is shaped into a funnel-form its wider open end on the top in order to prevent the flux used for improving the welding condition at the time of welding from entering inside.

Figure 3:
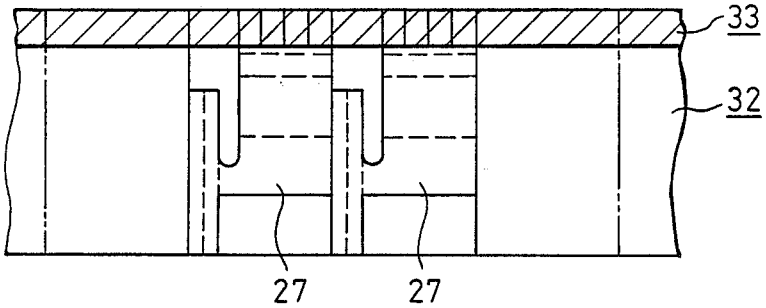
FIG. 3 is an explanatory drawing to explain the manufacturing process of the leaf-spring terminal shown in FIG. 1.

Leaf-spring terminal 27 shown in FIG. 3 is formed from a stainless strip 32 with the gold-plating provided on its top surface (33) by simultaneously performing punching of the part indicated with solid line and bending the part indicated with dotted line as illustrated in FIG. 1. Terminal 27 has contact 35 made of a gold-plated flat sheet with plural number of notches 34—34, projection 36 formed by bending the flat sheet and terminal member 29 having a V-shaped cross section that serves as a reinforcing rib and guide. Notches 34—34 may be provided either by cutting with a thin cutting edge or by punching with punch cutting die. Notches 34—34 are three in number, but the number may be either one or any plural number other than three.

Stationary terminal 28 is formed by bending a piece of phosphour bronze into almost L-shape and comprises a bend 37 provided at about the middle of the wire as a stopper and the other side of the wire forms terminal member 30. The key switch shown in FIG. 2 can be assembled automatically by the following processes:

(a) First, case cover 11 is turned over, and leaf-spring terminal 27 and stationary terminal 28 are installed securely.

(b) Key stem 14 and coil spring 19 are inserted.

(c) Case bottom cover 12 is fitted securely to case cover 11.

(d) Switch case 10 is turned over to put it back to the condition shown in FIG. 2, and stop lever 24 of key top 23 is forced into key stem 14 and locked.

The operation of said embodiment is as follows:

Under the condition described in FIG. 2, when the key top 23 is depressed, the key stem 14 that has been stopped by the key top 23 slides downward. To displace depressor 38 and allow projection 36 of the leaf-spring terminal 27 to deflect so that, the contact 35 of leaf-spring terminal 27 comes elastically into contact with the contact 31 of the stationary terminal 28 to electrically connect the terminals 27 and 28. In this mechanism, these terminals come into contact with each other at a least at plural number of points, since the contact 31 of the leaf-spring terminal 27 is provided with plural number of notches, and the contact 31 of the stationary terminal 28 consists of the circumferential surface of the wire.

When the downward depression to the key top 23 is removed, the key stem 14 and key top 23 slide upward owing to the pressure of the coil spring 19 to restore the condition described in FIG. 2. That is, the depressor 38 of key stem 14 depresses the projection 36 of leaf-spring terminal 27, and the contact 35 of leaf-spring terminal 27 is separated from the contact 31 of stationary terminal 28 to electrically disconnect these terminals 27 and 28.

As described in the above, the key switch according to the present invention has a stationary terminal formed from the wire and a leaf-spring terminal having a contact provided with plural number of notches, so that the contact at least at plural number of points can be obtained when the contacts of the stationary terminal and the leaf-spring terminal come into contact with each other. Thus, compared with the conventional key switch which normally provides the contact at only one point, the key switch according to the present invention can provide better condition and reliability of the contact. Furthermore, when the leaf-spring terminal is formed from a metal sheet such as a stainless steel sheet with its part corresponding to the contact plated with a precious metal such as the gold, and the stationary terminal is formed from a piece of phosphour bronze wire with its part corresponding to the contact plated with a precious metal such as silver or palladium, the reliability of the contact between the leaf-spring terminal and the stationary terminal can be maintained at a satisfactory level even where the contact pressure between the leaf-spring terminal and stationary terminal has dropped.

Also, when a tongue is provided to the stopper step of the key stem, and a projection to the stopper step of the switch case respectively to suppress the contact noise, the noise occurring at the time of the stop can be suppressed or reduced substantially.

Further, when the terminal insertion hole to be provided to the bottom cover of the switch case is shaped into funnel-shape opening upward and into the switch case, the flux used at the time of welding can be prevented from entering switch case through the terminal member of the stationary terminal. Further, when the terminal member of the leaf-spring terminal is shaped so that its cross section has V-shape, not only the terminal member of the leaf-spring terminal is reinforced but also the leaf-spring terminal can easily be installed to the switch case.

Furthermore, when a bend to serve as a stopper is formed on the stationary terminal, the stationary terminal can easily be installed to the switch case.

What is claimed is:

1. A key switch comprising a switch case having an opening and a key stem slidable within the opening, a leaf-spring terminal and a stationary terminal mounted within said switch case, sliding movement of said key stem causing movement of said-leaf spring terminal into and out of electrical contact with said stationary terminal, said leaf-spring terminal being provided with a contact and said stationary terminal including a wire, wherein the key stem and the switch case include stops to limit movement relative to each other, said stops including a tongue and a projection provided on said key stem and said switch case, respectively, so that said tongue and said projection come into single point to point contact with each other to thereby serve as a contact noise suppressor.

2. A key switch according to claim 1, said switch case including a bottom cover having a terminal insertion hole receiving the stationary terminal, said hole having a funnel-shape opening upward into said switch case.

3. A key switch according to claim 2, wherein the leaf-spring terminal is formed so that a cross section of a terminal member thereof is generally V-shaped.

4. A key switch according to claim 1, wherein the leaf-spring terminal is formed so that a cross section of a terminal member thereof is generally V-shaped.

5. The key switch of claim 1, wherein said leaf-spring terminal contact includes at least one notch.

6. A key switch comprising a switch case having an opening and a key stem slidable within the opening, a leaf-spring terminal and a stationary terminal mounted within said switch case, sliding movement of said key stem causing movement of said-leaf spring terminal into and out of electrical contact with said stationary terminal, said leaf-spring terminal being provided with a contact having at least one notch and said stationary terminal including a wire, wherein the leaf-spring terminal is formed with a contact, and the stationary terminal is formed from a piece of wire, wherein the key stem and the switch case are provided with stopper steps and the stopper step of said key stem and the stopper step of said switch case are provided with a tongue and a projection respectively so that said tongue and said projection come into contact with each other before said key stem and said switch case come into contact, thereby serving as noise suppressors.

7. A key switch according to claim 6, said switch case including a bottom cover having a terminal insertion hole receiving the stationary terminal, said hole having a funnel-shape opening upward into said switch case.

8. A key switch according to claim 7, wherein the leaf-spring terminal is formed so that a cross section of a terminal member thereof is generally V-shaped.

9. A key switch according to claim 7, wherein the leaf-spring terminal is formed so that a cross section of a terminal member thereof is generally V-shaped.

10. The key switch of claim 6, wherein said leaf-spring terminal is formed from an elastic sheet metal having said contact plated with a precious metal and said piece of wire is a phosphor bronze wire with its contact plated with a precious metal.

11. The key switch of claim 6, wherein said tongue and projection provide single point to point contact with each other.

12. The key switch of claim 11, wherein said projection is a semi-circular protuberance in cross-section.

13. The key switch of claim 11, wherein said projection is a thin plate-like projection of rectangular cross-section.

14. A key switch comprising a switch case having an opening, a key stem which is fitted in said switch case for sliding movement therewithin, spring means in said switch case for biasing said key stem into an upper position, with a part of said key stem projecting outside through the opening of said switch case, a stationary terminal with a contact made of a wire disposed generally orthogonally to the direction of slide of said key stem, said contact fitted stationarily in said switch case and a leaf-spring terminal installed in said switch case and having a contact elastically deformable into contact with the contact of said stationary terminal, said leaf-spring contact including at least one notch formed for obtaining plural contact points with the stationary wire contact, said key stem includes a depressor for depressing a projection of said leaf-spring terminal to (1) cause the contact of said leaf-spring terminal to be separated from the contact of said stationary terminal when said key stem is forced upward and held there by said spring means and (2) release the depressing force on the projection of said leaf-spring terminal to cause the contact of said leaf-spring terminal to be brought into contact with the contact of said stationary terminal by the elastic force of said leaf-spring terminal when said key stem is slidably moved downward.

15. A key switch according to claim 14, wherein the contact of the leaf-spring terminal includes at least three notches.

16. A key switch comprising a switch case having an opening and a key stem slidable within the opening, a leaf-spring terminal and a stationary terminal mounted within said switch case, sliding movement of said key stem causing movement of said-leaf spring terminal into and out of electrical contact with said stationary terminal, said leaf-spring terminal being provided with a contact and said stationary terminal including a wire, wherein the key stem and the switch case include stops to limit movement relative to each other, said stops including a tongue and a projection provided on said key stem and said switch case, respectively, so that said tongue and said projection come into contact with each other to thereby serve as a contact noise suppressor, said stops being stopper steps formed on the key stem and switch case on which stopper steps the tongue and projection are respectively located.

* * * * *